US011952733B2

(12) United States Patent
Healy et al.

(10) Patent No.: US 11,952,733 B2
(45) Date of Patent: Apr. 9, 2024

(54) ANIMAL EXCREMENT DISPOSAL APPARATUS AND METHOD OF USE

(71) Applicant: Feces to Piece-Ease LLC, Palm Coast, FL (US)

(72) Inventors: Brian Kent Healy, Palm Coast, FL (US); Allan Rust Healy, Palm Coast, FL (US)

(73) Assignee: Feces to Piece-Ease LLC, Palm Coast, FL (US)

( * ) Notice: Subject to any disclaimer, the term of this patent is extended or adjusted under 35 U.S.C. 154(b) by 0 days.

(21) Appl. No.: 18/202,989

(22) Filed: May 29, 2023

(65) Prior Publication Data

US 2023/0399802 A1 Dec. 14, 2023

Related U.S. Application Data

(60) Provisional application No. 63/473,573, filed on Jun. 8, 2022.

(51) Int. Cl.
*E01H 1/12* (2006.01)

(52) U.S. Cl.
CPC ..... *E01H 1/12* (2013.01); *E01H 1/1213* (2013.01); *E01H 2001/1293* (2013.01)

(58) Field of Classification Search
CPC ..... E01H 1/008; E01H 1/12; E01H 1/1213; E01H 1/101; E01H 2001/1293
See application file for complete search history.

(56) References Cited

U.S. PATENT DOCUMENTS

| | | | | |
|---|---|---|---|---|
| 1,790,908 | A | 2/1931 | Fitts | |
| 3,753,408 | A | 8/1973 | Zimmerman | |
| 3,770,204 | A * | 11/1973 | Schuster | B05B 1/28 4/255.05 |
| 3,817,194 | A * | 6/1974 | Seebald | E01H 1/1206 111/7.1 |
| 3,968,937 | A | 7/1976 | Miller | |
| 4,302,040 | A | 11/1981 | Lazar | |
| 4,744,380 | A | 5/1988 | Sheriff | |
| 4,863,108 | A | 9/1989 | Mitchell | |
| 4,957,131 | A * | 9/1990 | Robinson | E01H 1/103 134/182 |

(Continued)

FOREIGN PATENT DOCUMENTS

DE 202019101175 U1 4/2019

*Primary Examiner* — Dean J Kramer
(74) *Attorney, Agent, or Firm* — Lippes Mathias LLP; Mitchell Ghaneie; Josephine Chen

(57) ABSTRACT

The present disclosure presents an apparatus which assists with disposal of animal excrement. The apparatus includes a conduit having a first end and a second end, wherein the first and second ends are fluidly coupled to a handle and a nozzle, respectively. The handle is fluidly coupled to a water source and provides a lever that is operably coupled to an internal valve allowing the user to control the flow rate of water through the conduit and nozzle. The apparatus further includes a splash guard that is coupled to the nozzle and extends a predetermined distance beyond the exit orifice of the nozzle. The nozzle and splash guard are engineered to produce a turbulent churning of the discharged water when the splash guard is in sufficient contact with the ground that allows for the rapid breakdown and dissolution of the animal excrement.

16 Claims, 15 Drawing Sheets

(56) References Cited

U.S. PATENT DOCUMENTS

| | | | | |
|---|---|---|---|---|
| 6,077,362 | A | 6/2000 | Reed | |
| 6,233,949 | B1 * | 5/2001 | Baker | E01H 1/00 62/64 |
| 8,187,391 | B2 | 5/2012 | Wood | |
| 2005/0218156 | A1 | 10/2005 | Goldberg | |
| 2006/0249537 | A1 | 11/2006 | Goldberg | |
| 2008/0093486 | A1 | 4/2008 | Orubor | |
| 2016/0212967 | A1 | 7/2016 | Giles et al. | |

* cited by examiner

ANIMAL EXCREMENT DISPOSAL APPARATUS AND METHOD OF USE

CROSS-REFERENCE TO RELATED APPLICATION

This application claims the benefit of U.S. Provisional Application No. 63/473,573, filed Jun. 8, 2022, and is hereby incorporated by reference in its entirety for all purposes.

FIELD OF THE INVENTION

The subject matter disclosed herein generally relates to in-situ disposal of animal excrement and more specifically to an apparatus configured to couple to a pressurized fluid source to facilitate rapid disintegration and dissolution of animal excrement.

BACKGROUND

Proper management of animal excrement is essential to maintain cleanliness in public areas, including parks, lawns, sidewalks, and streets. Municipalities in many countries have enacted laws and regulations mandating pet owners to promptly remove their pets' waste from public areas. Similarly, pet owners living in suburban and rural areas are required to dispose of pet waste to maintain cleanliness in their yards. Many pet owners use plastic or paper bags to collect pet waste; however, the process of manually handling pet waste is often considered an unpleasant and unsanitary task. Moreover, some pet owners are physically restricted and not capable of performing such collection.

In addition to pet waste, in many regions, undomesticated animals may often access residential properties and leave excrement on the lawns of private residences. In such cases, collection of excrement using similar methods as described above can be even more tedious and arguably impractical. Consequently, there is a need for an apparatus to facilitate the disposal of animal excrement, particularly in a manner that is convenient, hygienic, and efficient.

SUMMARY OF THE INVENTION

The following is a concise summary of the invention presented herein with the primary aim of providing a preliminary understanding of certain aspects of the invention. It should be noted, however, that this summary is not intended to serve as a comprehensive overview of the invention, nor does it seek to identify or describe any critical or significant elements of the invention or the boundaries of its scope. Its sole purpose is to provide a rudimentary understanding of the invention's concepts and features, which will be expounded upon in greater detail in the ensuing sections.

The present disclosure is generally directed towards disposing of animal excrement without necessitating such excrement be collected or manually handled. An exemplary, nonlimiting embodiment of the present disclosure provides an apparatus which assists with rapid disintegration and dissolution of animal excrement. The apparatus includes a handle, a conduit, a nozzle, and a splash guard. It is preferrable that the apparatus be constructed of rigid or semi-rigid materials.

The handle is substantially cylindrical. The handle includes a proximal end and a distal end. The proximal end may be configurable to fluidly couple to a water source, such as a garden hose or power washer. The handle further includes an inner conduit with an internal valve that is operably coupled to an exterior lever which allows a user to control the valve to regulate the flow rate of water from the proximal end to the distal end. The lever may be configured between a plurality of orientations to dispose the valve between a plurality of positions ranging from fully closed to fully open. It is anticipated an alternative mechanical mechanism may be used to regulate the flow rate of water into the apparatus without departing from the spirit of the invention.

The conduit includes a first end and a second end. The first end of the conduit is coupled to and in fluid communication with the distal end of the handle. The conduit directs the flow of water from the distal end of the handle to the nozzle. The conduit preferably has three sections and may either be unitarily constructed or formed uniformly.

The nozzle has an inlet and a dome shaped cap, which are substantially located on opposing ends of the nozzle. The inlet is coupled to the second end of the conduit. The dome shaped cap provides an exit orifice which includes a first and second slit. The two slits orthogonally intersect and preferably do not have equal arc lengths. The splash guard has a truncated elliptical cone profile with a proximal top end and a distal base. The boundary of the distal base has a semi-major axis and semi-minor axis. The first and second slits have arc lengths that are proportional to the semi-major and semi-minor diameters, respectively. Importantly, the exit orifice is located at predetermined distance above the distal base to ensure water discharging from each of the slits substantially reaches the boundary of the distal base at substantially the same time, which in turn optimizes the disintegration of the animal excrement.

Preferably the nozzle provides a female coupling mechanism to allow the splash guard to attach to the nozzle. However, it is anticipated that the splash guard and nozzle could be unitarily constructed or coupled to one another using an alternative mechanical coupling mechanism.

The boundary of the distal base of the splash guard provides a bottom edge that is preferably a flat edge. However, other profiles of the bottom edge are anticipated and may be alternatively utilized. Such alternative profiles may include, but are not limited to, a saw-tooth edge, a beveled edge, or a wavey edge.

NUMBER REFERENCES

10—Exemplary Embodiment of the Apparatus
20—Handle
20A—Proximal End
20B—Distal End
21—Lever
22—Valve
25—Conduit
25A—First End
25B—Second End
26—Horizontal Section
27—Diagonal Section
28—Vertical Section
30—Nozzle
31—Coupler
35—Cap
36—First Slit
37—Second Slit
50—Splash Guard
55—Bottom Edge
60—Water Source
70—Animal Excrement
75—Heterogeneous Mixture
110—Alternative Embodiment of the Apparatus
125—Conduit
125A—First End
125B—Second End
130—Nozzle
150—Splash Guard
155—Bottom Edge
D1—Semi-Major Diameter
D2—Semi-Minor Diameter
L1—Projected Linear Length of First Slit
L2—Projected Linear Length of Second Slit
$\alpha_1$—First Angle
$\alpha_2$—Second Angle

DETAILED DESCRIPTION

The following detailed description and accompanying drawings provide a comprehensive disclosure of exemplary embodiments for the purpose of facilitating one of ordinary skill in the relevant art to make and use the invention. Therefore, the detailed description and illustration of the one or more exemplary embodiments presented herein are purely exemplary in nature and are not intended to limit the scope of the invention or its protection in any manner. It is further noted that the drawings may not be to scale, and in some cases, certain details may be omitted which are not necessary for an understanding of the present invention, such as conventional details of fabrication and assembly.

In one aspect, the invention is generally directed to the disposal of animal excrement 70 by way of innovative hydraulic techniques that allows one to dispose of such animal excrement 70 without necessitating collection or manual relocation. In this aspect, an exemplary embodiment of the present disclosure may be designed to attach to a pressurized water source, such as, but not limited to, a garden hose or power washer and may be adapted for use with multiple fitting types to achieve such attachment.

Figure 1:
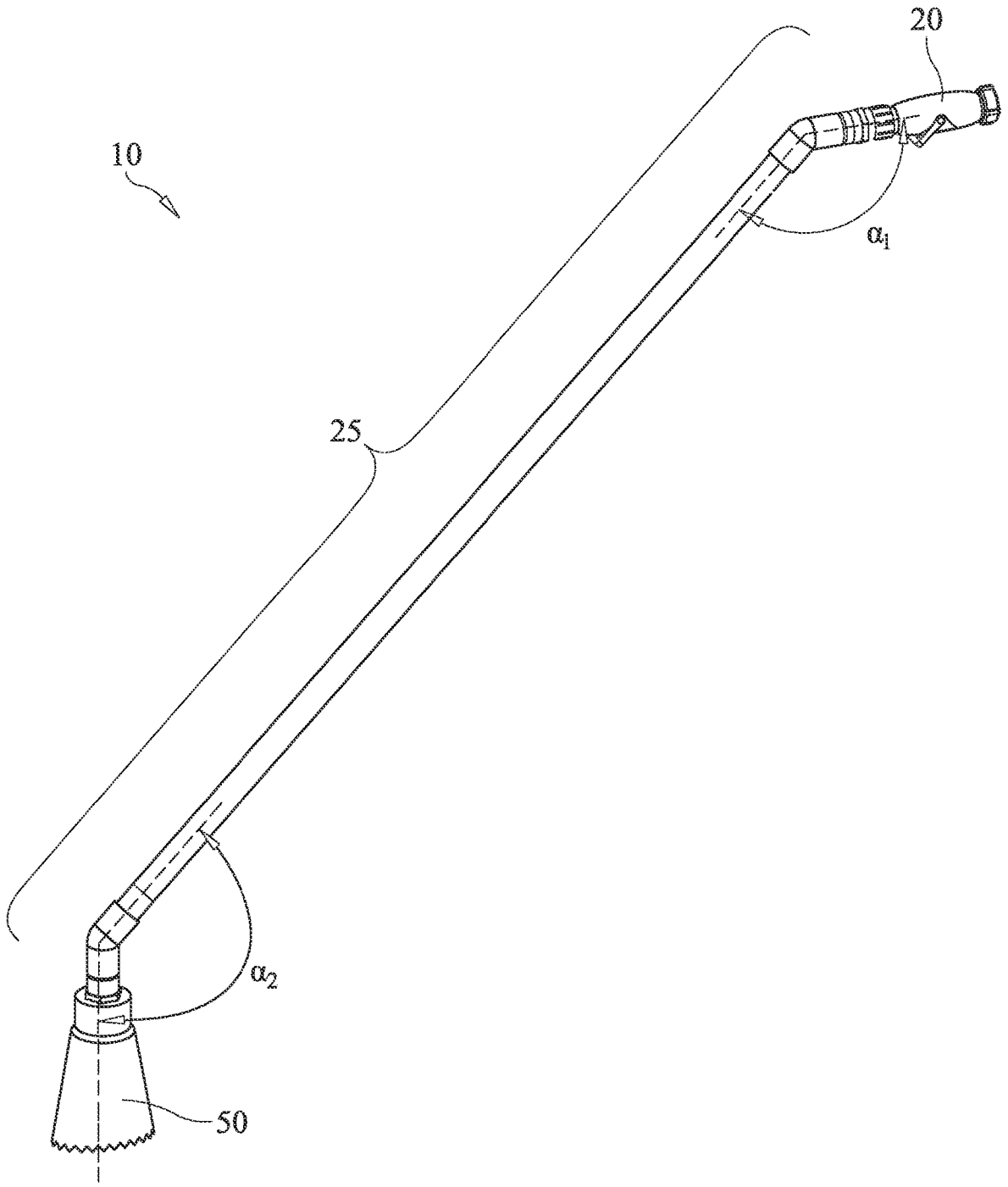
FIG. 1 depicts a perspective view of an exemplary embodiment of an apparatus.
Figure 2:
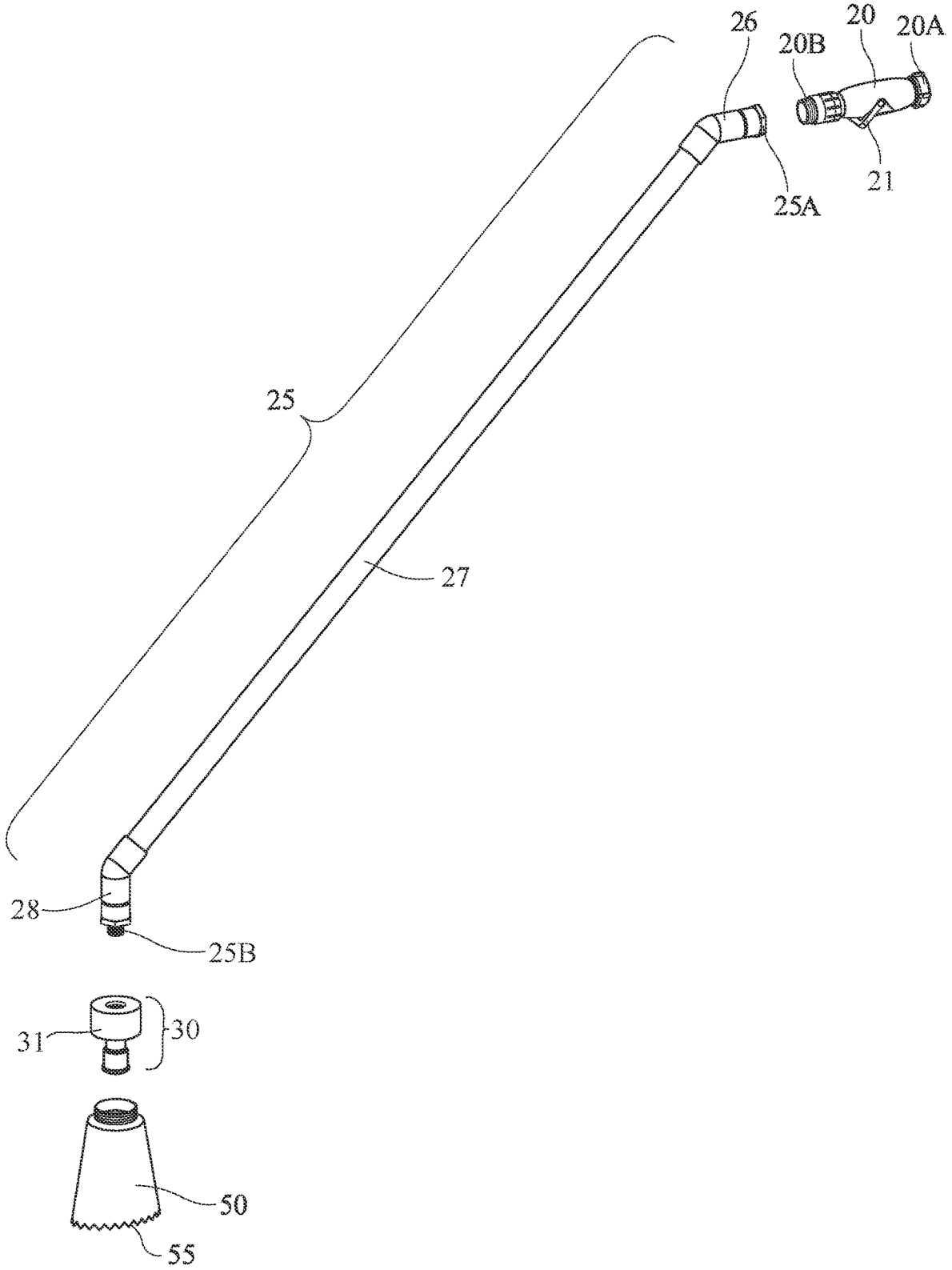
FIG. 2 depicts an exploded perspective view of the exemplary embodiment of the apparatus.
Figure 2A:
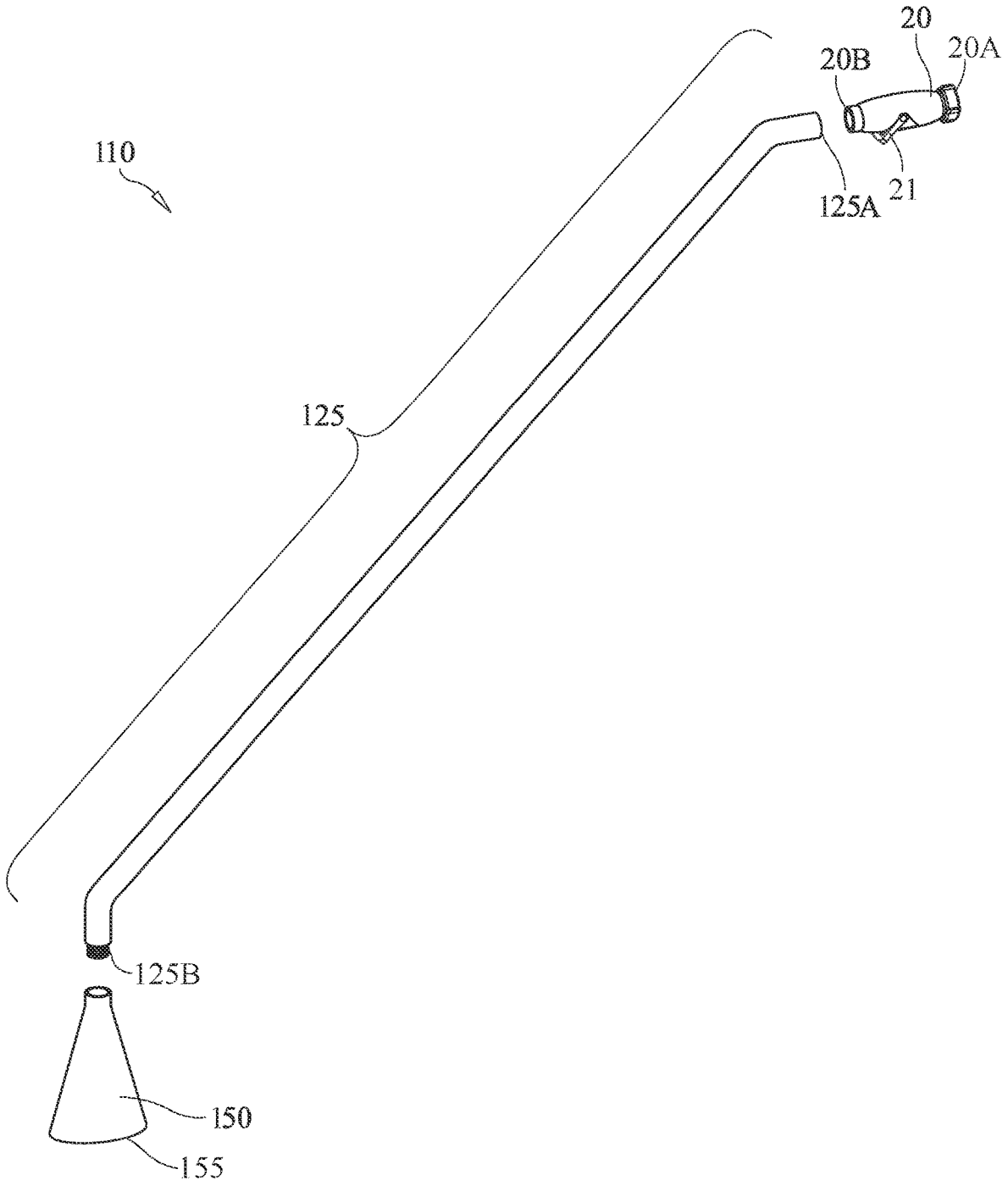
FIG. 2A depicts an exploded perspective view of the alternative embodiment of the apparatus.

An exemplary, nonlimiting embodiment of the present disclosure provides an apparatus 10, as shown in FIGS. 1 and 2, which assists with rapid disintegration and dissolution of animal excrement 70 for efficient disposal thereof. The exemplary embodiment of the apparatus 10, hereinafter referred to as the apparatus 10, includes a handle 20, a conduit 25, a nozzle 30, and a splash guard 50. It is preferrable that the apparatus 10 be constructed of rigid or semi-rigid materials which are resistive to corrosion or coated with coatings that provide resistance to corrosion.

Figure 3:
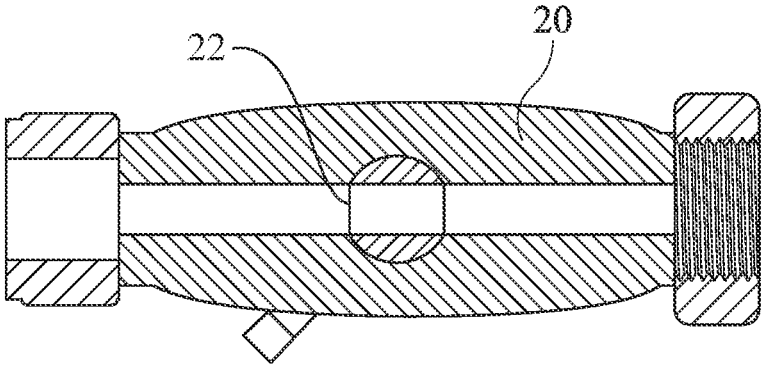
FIG. 3 depicts a cross-section of an exemplary handle of the exemplary embodiment of the apparatus.
Figure 9:
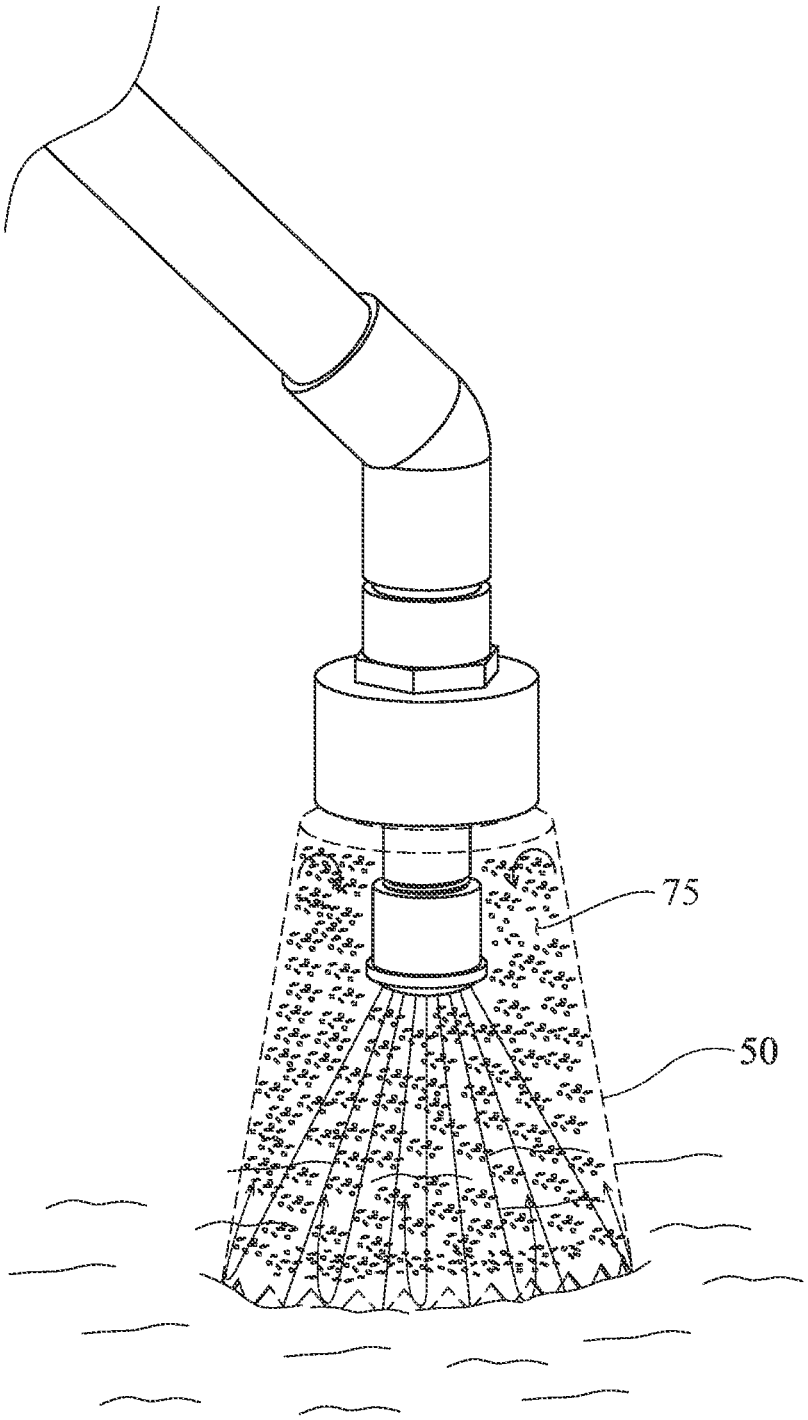
FIG. 9 depicts an enlarged in-use perspective view of the splash guard and nozzle of the exemplary embodiment of the apparatus wherein the discharged water has filled the volume enclosed by the splash guard and is turbulently churning and dissolving the animal excrement within a resulting heterogenous mixture.
Figure 9A:
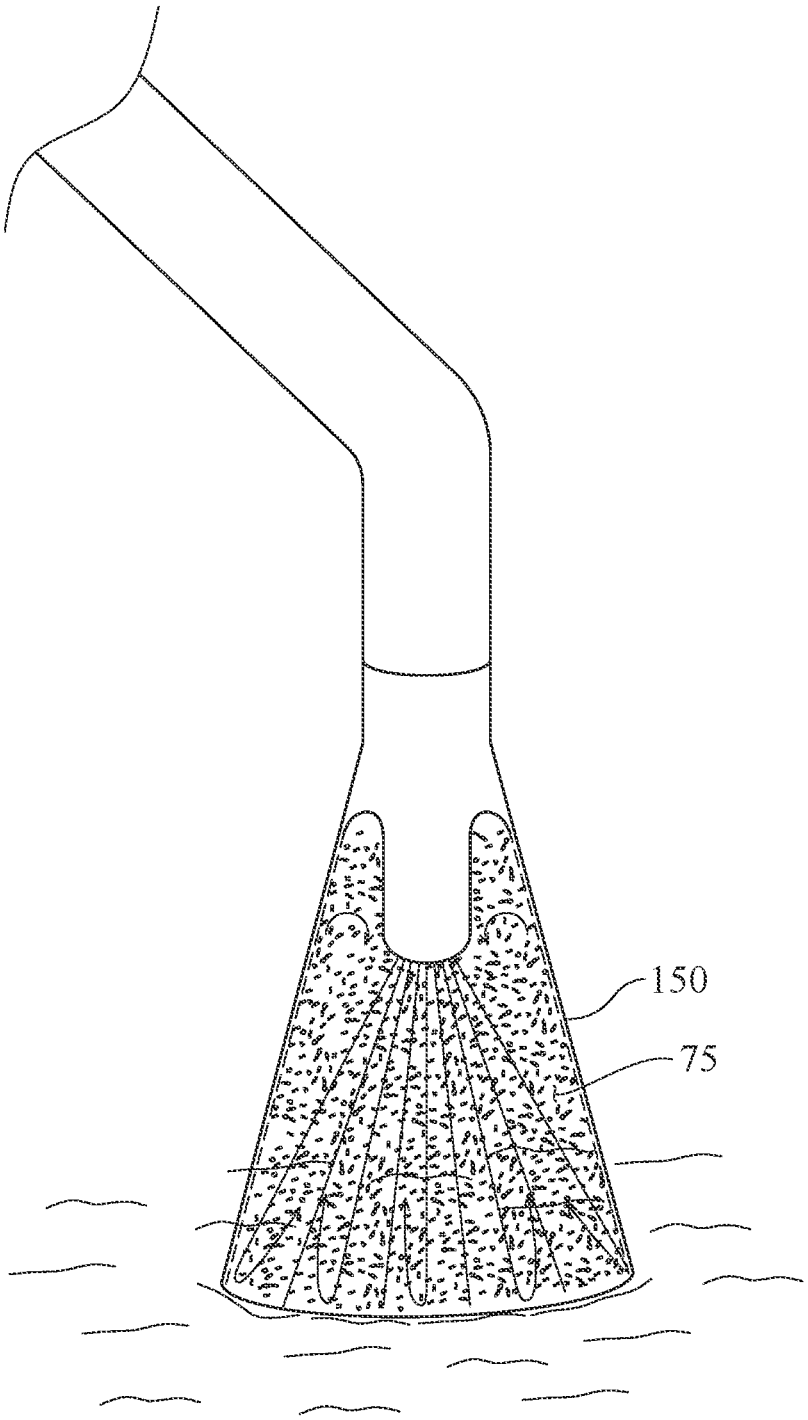
FIG. 9A depicts an enlarged in-use perspective view of the splash guard and nozzle of the alternative embodiment of the apparatus wherein the discharged water has filled the volume enclosed by the splash guard and is turbulently churning and dissolving the exemplary animal excrement within the resulting heterogenous mixture.
Figure 10:
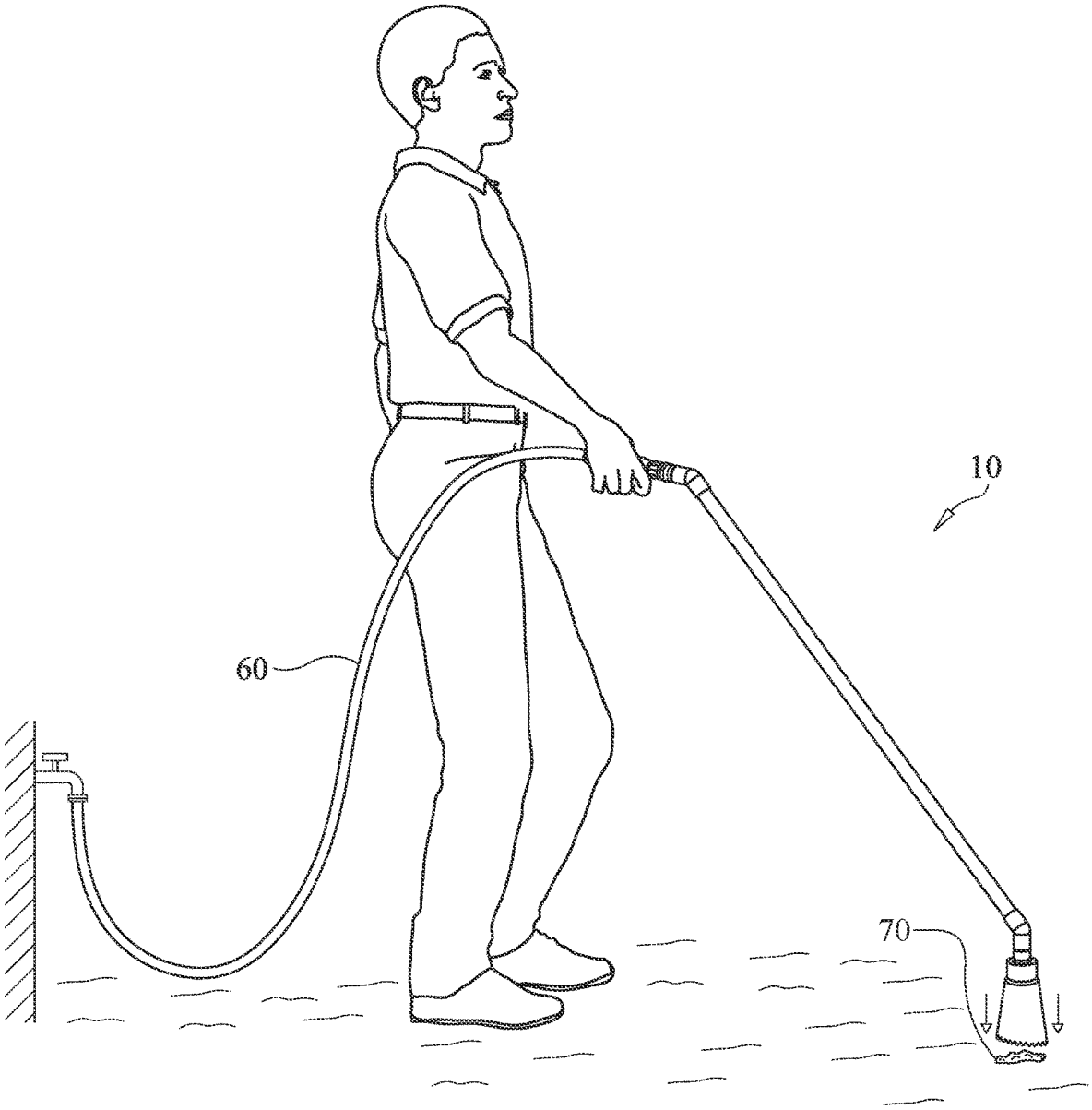
FIG. 10 depicts an in-use perspective view of an exemplary user of the exemplary embodiment of the apparatus placing the splash guard over the exemplary animal excrement.

The handle 20 is substantially cylindrical to allow for water to flow internally along its longitudinal axis. The handle 20 includes a proximal end 20A and a distal end 20B. The proximal end 20A may be configurable to fluidly couple to a water source 60, such as, for example, a garden hose as illustrated in FIGS. 9 and 10. As shown in FIG. 3, the handle 20 further includes an inner conduit, which spans linearly along its longitudinal axis, that includes an internal valve 22 that is operably coupled to an external lever 21 which allows a user to control the valve to regulates the flow rate of water from the proximal end 20A to the distal end 20B. The lever 21 may be configured between a plurality of orientations to dispose the valve 22 between a plurality of positions ranging from fully closed to fully open. It is anticipated that a plurality of alternative mechanical mechanisms may be employed in place of the lever 21 to control the valve 22 and regulate the flow rate of water through the handle 20 without departing from the spirit of the invention.

The conduit 25 includes a first end 25A and a second end 25B. The first end 25A of the conduit 25 is coupled to and in fluid communication with the distal end 20B of the handle 20. The conduit 25 preferably includes a horizontal section 26, a diagonal section 27, and a vertical section 28. Each of the three sections 26, 27, 28 is preferably coplanar with respect to one another. As shown in FIGS. 1 and 2, the intersections of the longitudinal axis of the diagonal section 27 with the longitudinal axes of the horizontal and vertical sections 26, 28 form an angle of $\alpha_1$ and $\alpha_2$, respectively. Further, the horizontal and vertical sections 26, 28 have longitudinal axes that are preferably substantially orthogonal with respect to each other.

Figure 4:
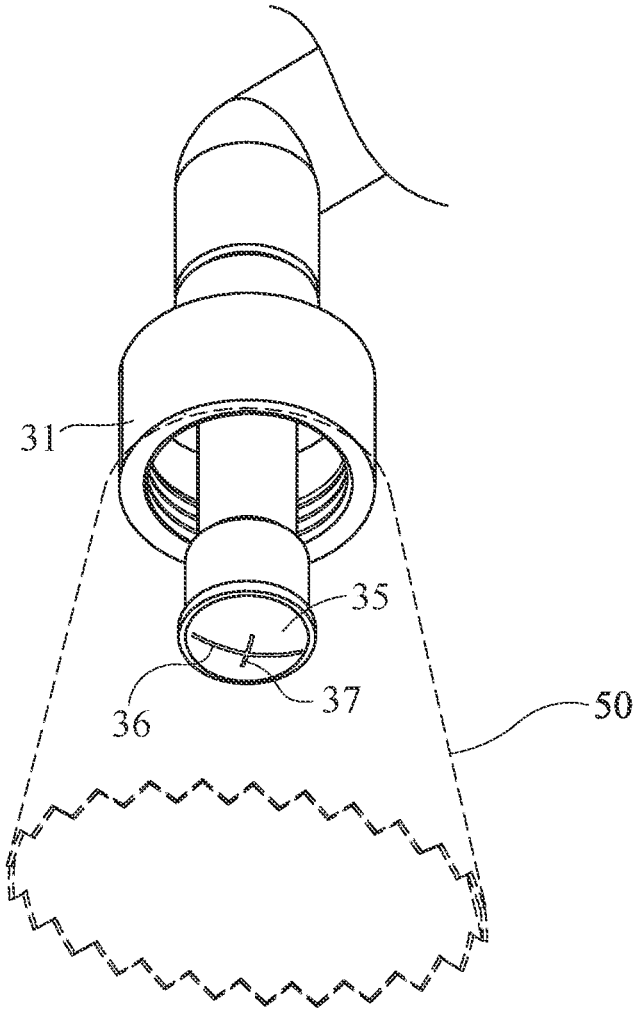
FIG. 4 depicts an enlarged perspective view of the exemplary embodiment wherein a nozzle is mechanically coupled to a conduit and a splash guard.

The nozzle 30 spans from its inlet to a dome shaped cap 35 on its opposing end. The inlet is coupled to the second end 25B of the conduit 25. The dome shaped cap 35 provides an exit orifice which includes a first slit 36 and a second slit 37. The two slits 36, 37 intersect each other substantially at their respective midpoints and are substantially tangentially orthogonal at their point of intersection. Each of the slits 36, 37 preferably traverse along a substantially geodesic trajectory with respective to the curved surface of the dome shaped cap 35. As illustrated in FIG. 4, the two slits 36, 37 preferably do not have equal arc lengths.

The splash guard 50 forms a truncated elliptical cone profile with a proximal top end and a distal base. As shown in FIG. 2, the proximal end couples to a female coupler 31 provided by the nozzle 30. While a threaded connection is exemplified in FIGS. 2 and 4, it is anticipated that the splash guard 50 and nozzle 30 could be unitarily constructed or coupled to one another using an alternative mechanical coupling mechanism, such as, but not limited to, a spring loaded quick connect mechanism.

Figure 5:
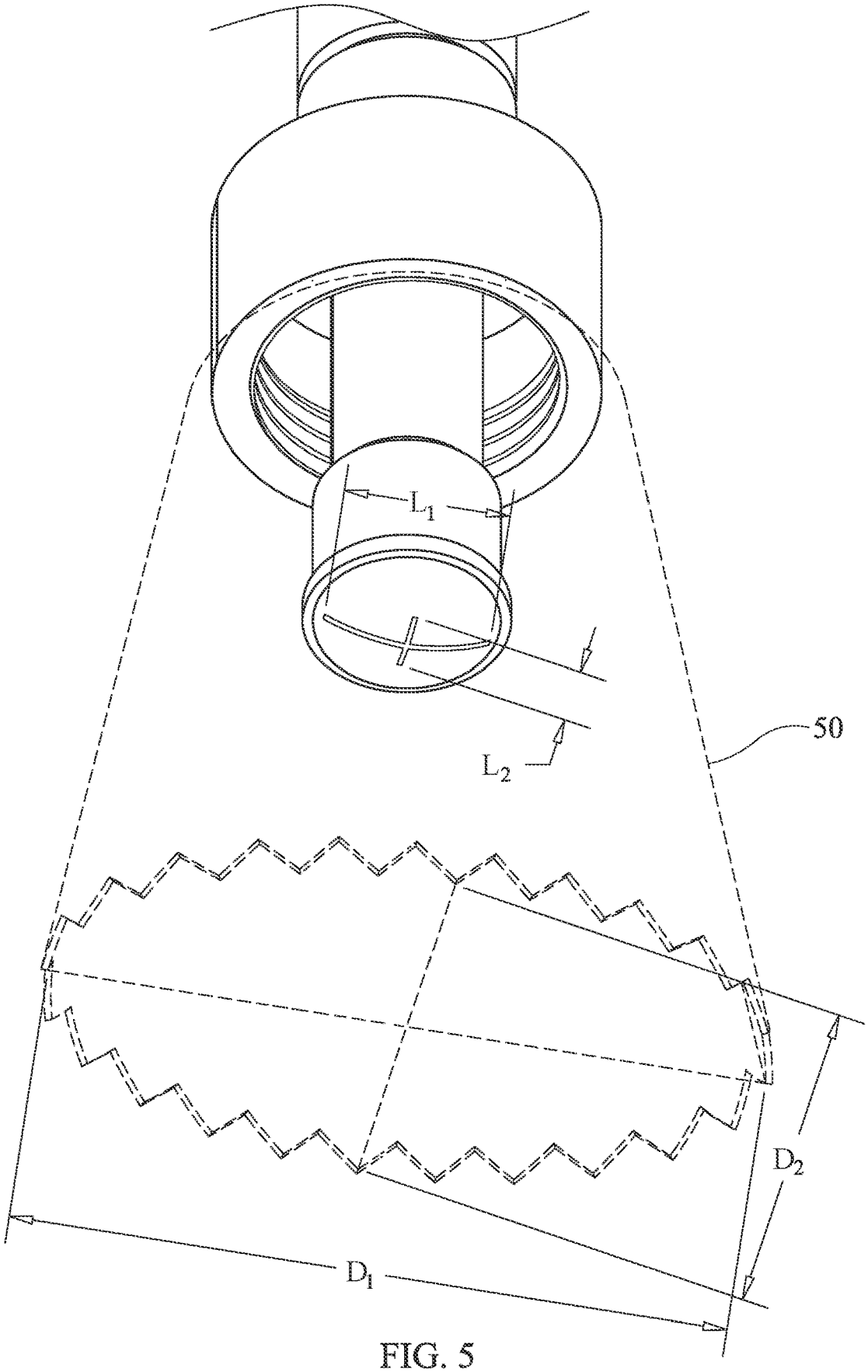
FIG. 5 depicts an enlarged perspective view of the nozzle of the exemplary embodiment and various dimensionally proportional relationships between the nozzle and the splash guard.

The elliptical boundary of the distal base has a semi-major diameter D1 and semi-minor diameter D2. Referring to FIG. 5, the first and second slits 36, 37 each have projected linear lengths L1, L2 that are proportional to the semi-major and semi-minor diameters D1, D2, respectively. The linear projected lengths L1, L2 are influenced by both the vertical offset of the point of intersection of the two slits 36, 37 and the respective magnitudes of the semi-major and semi-minor diameters, D1, D2. Importantly, the curvature and respective arch lengths of the two slits 36, 37 allow the discharge to depart from the exit orifice such that the discharge fans elliptically and reaches the boundary of the distal base at substantially the same time. It is anticipated that D1 and D2, in other alternative embodiments, may be substantially equivalent, thereby resulting in L1 and L2 to be substantially equivalent.

Figure 8:
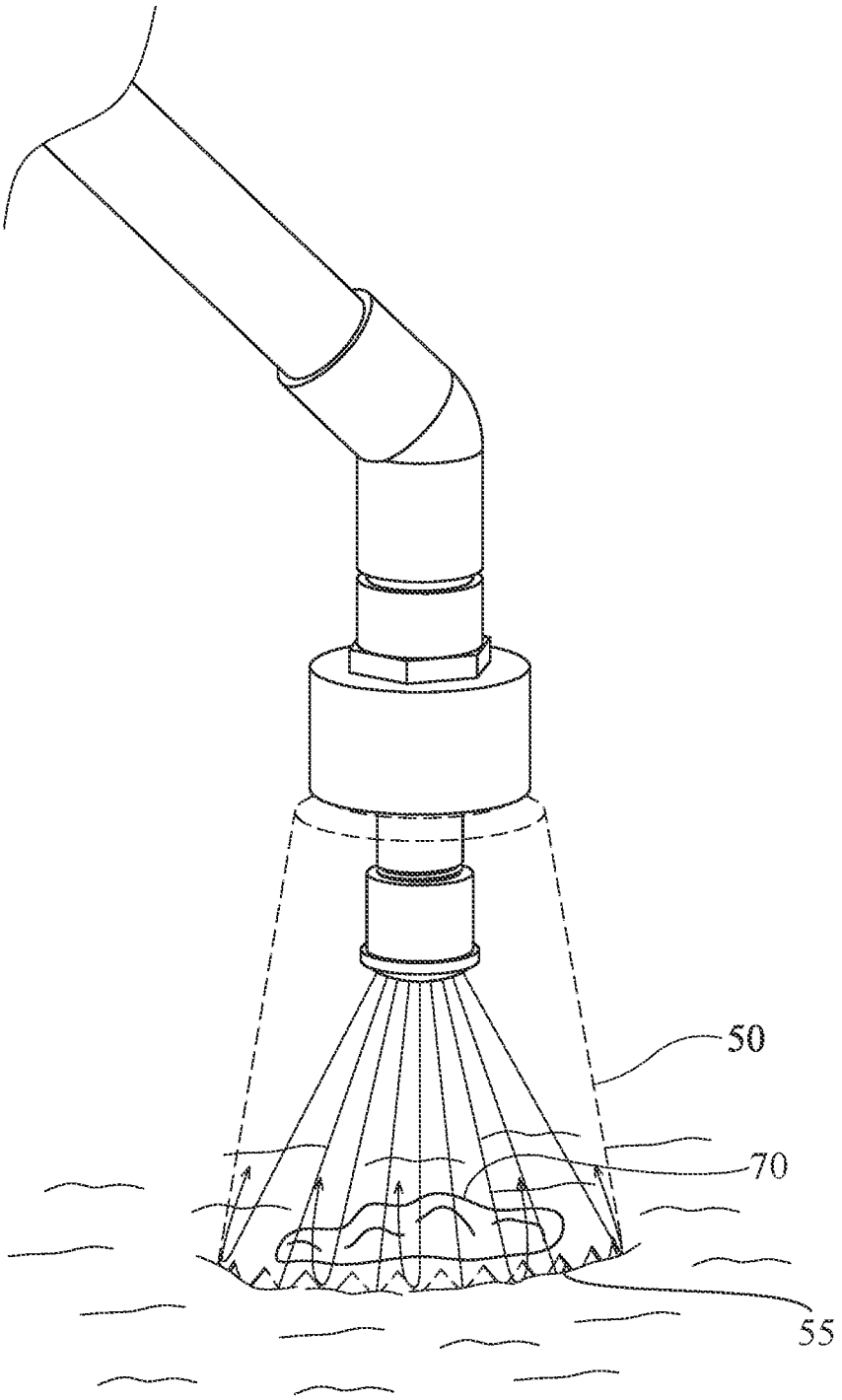
FIG. 8 depicts an enlarged in-use perspective view of the splash guard of the exemplary embodiment of the apparatus wherein said splash guard encloses an exemplary animal excrement and water, which is discharging from the nozzle, is beginning to fill the volume within the splash guard.
Figure 8A:
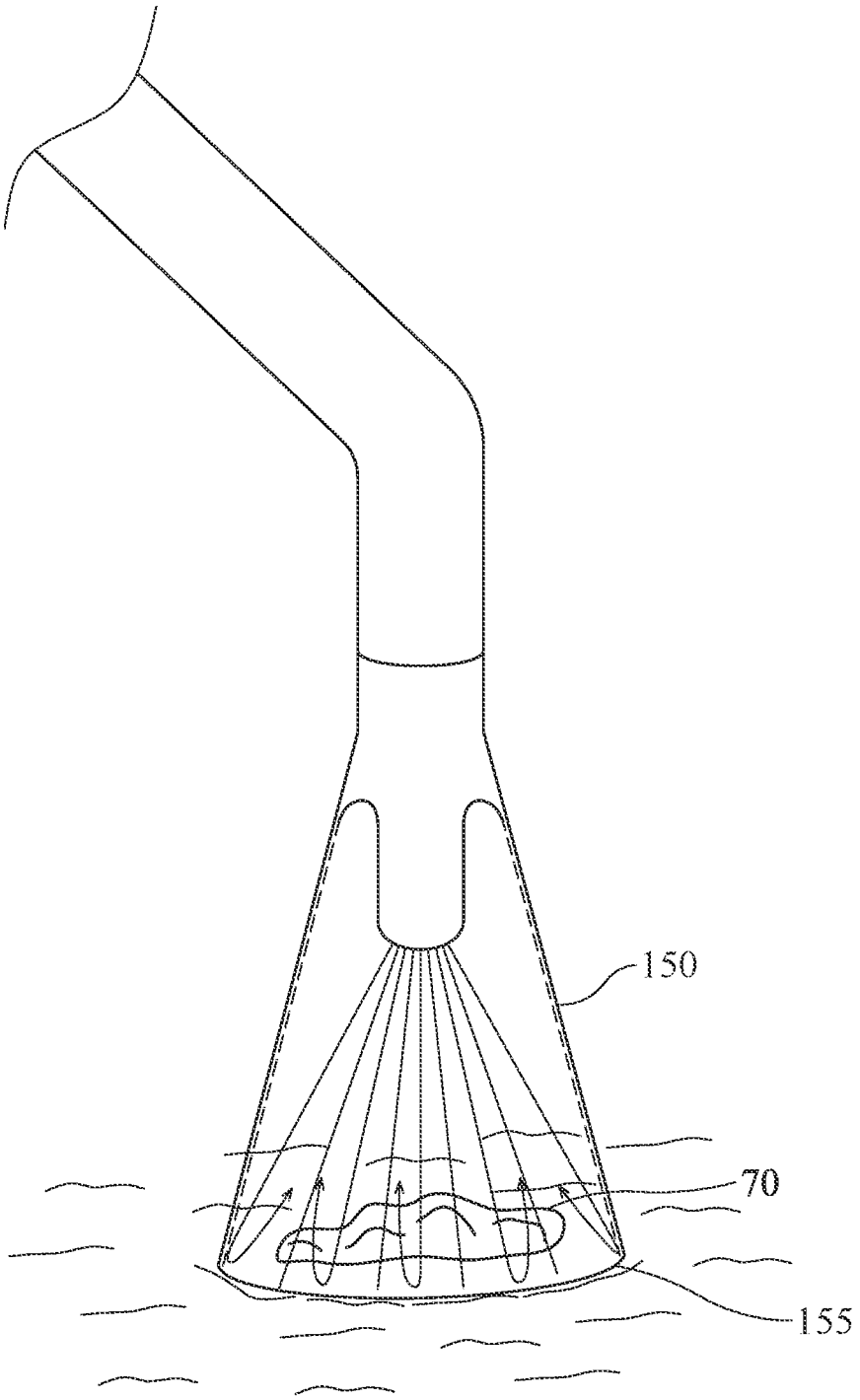
FIG. 8A depicts an enlarged in-use perspective view of the splash guard of the alternative embodiment of the apparatus wherein said alternative splash guard encloses the exemplary animal excrement and water, which is discharging from the nozzle, is beginning to fill the volume within the splash guard.

This precise angular discharge created by the two slits 36, 37 promotes the rapid disintegration of the animal excrement 70 by creating turbulent vortices as the volume within the splash guard 50 fills with water, as illustrated in FIG. 8. A heterogenous mixture 75 results from the pressurized discharge mixing with the exemplary animal excrement 70 and any other loose or soluble in-situ matter that is enclosed by the splash guard 50, This turbulent blending effect is further improved by the vertical position of the exit orifice 36, 37 being located at a predetermined distance below the proximal top end of the splash guard 50. Substantial improvements to the efficiency of disintegrating the animal excrement 70 is achieved by leveraging this unique assembly relative to other techniques presented in the prior art.

Figure 7:
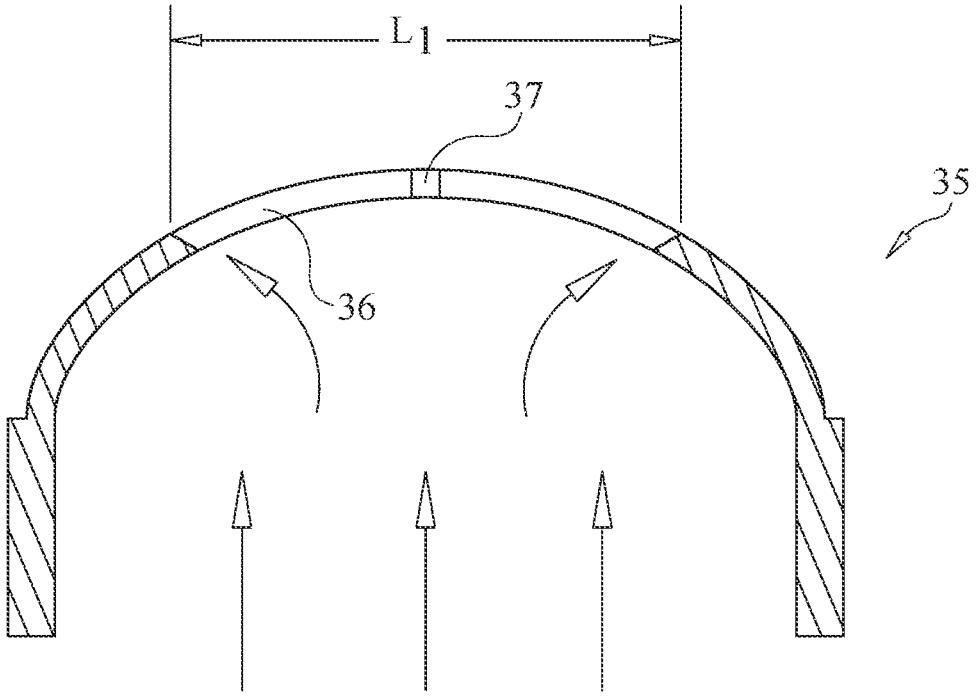
FIG. 7 depicts a cross-sectional view taken along line A-A in FIG. 6.
Figure 6A:
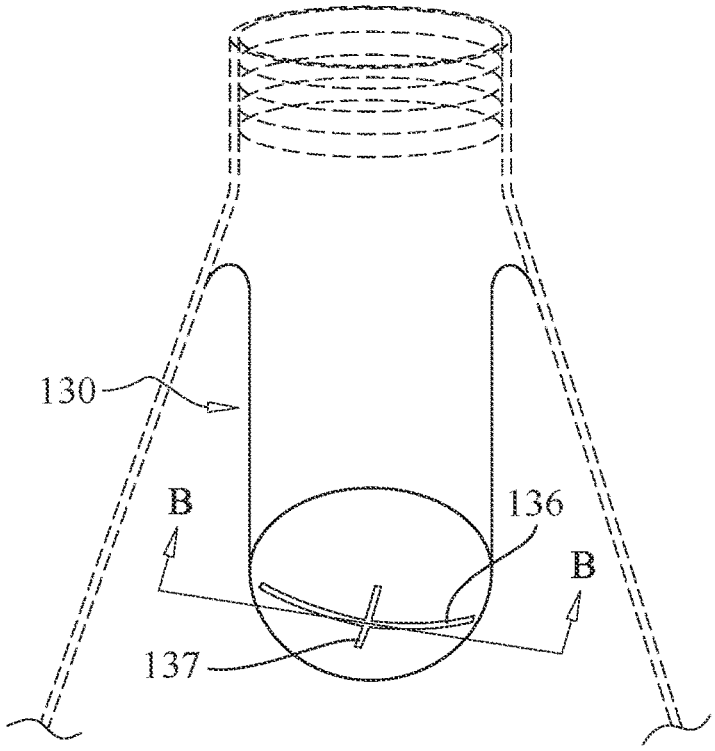
FIG. 6A depicts an enlarged perspective view of the nozzle of the alternative embodiment of the apparatus.
Figure 7A:
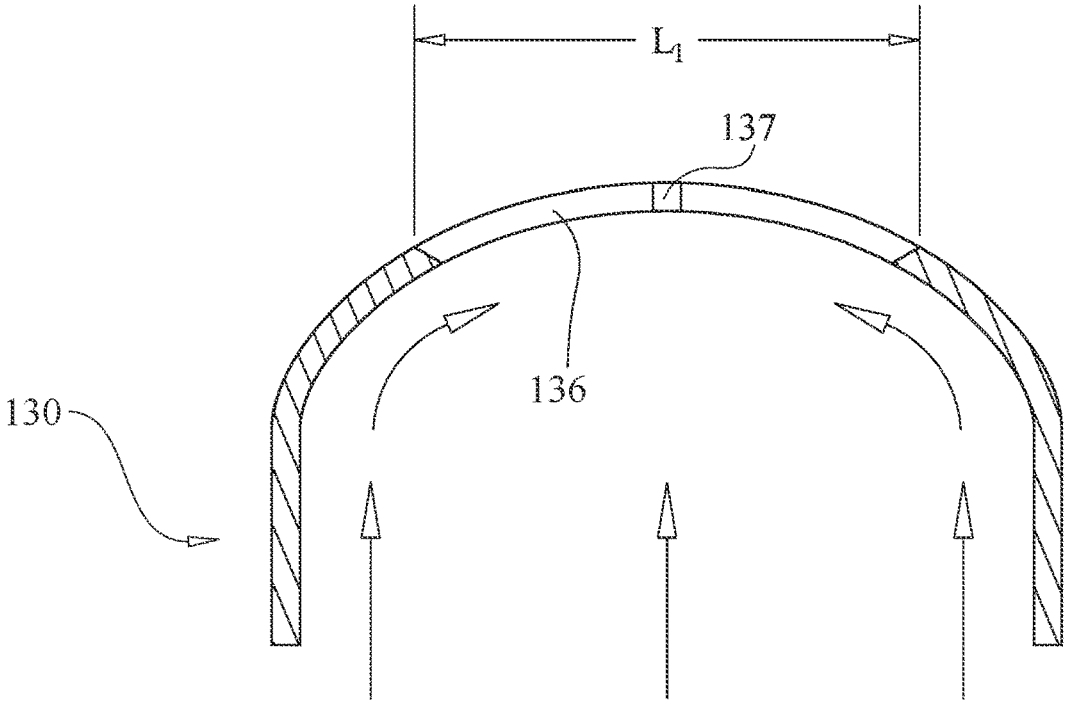
FIG. 7A depicts a cross-sectional view taken along line B-B in FIG. 6A.

Referring to FIGS. 7, the boundary of the base of the splash guard 50 provides a bottom edge 55 that is preferably saw-toothed to assist with creating a tighter seal with the ground. However, other profiles of the bottom edge are anticipated and may be alternatively utilized. Such alternative profiles include, but are not limited to, a flat or beveled edge.

Figure 1A:
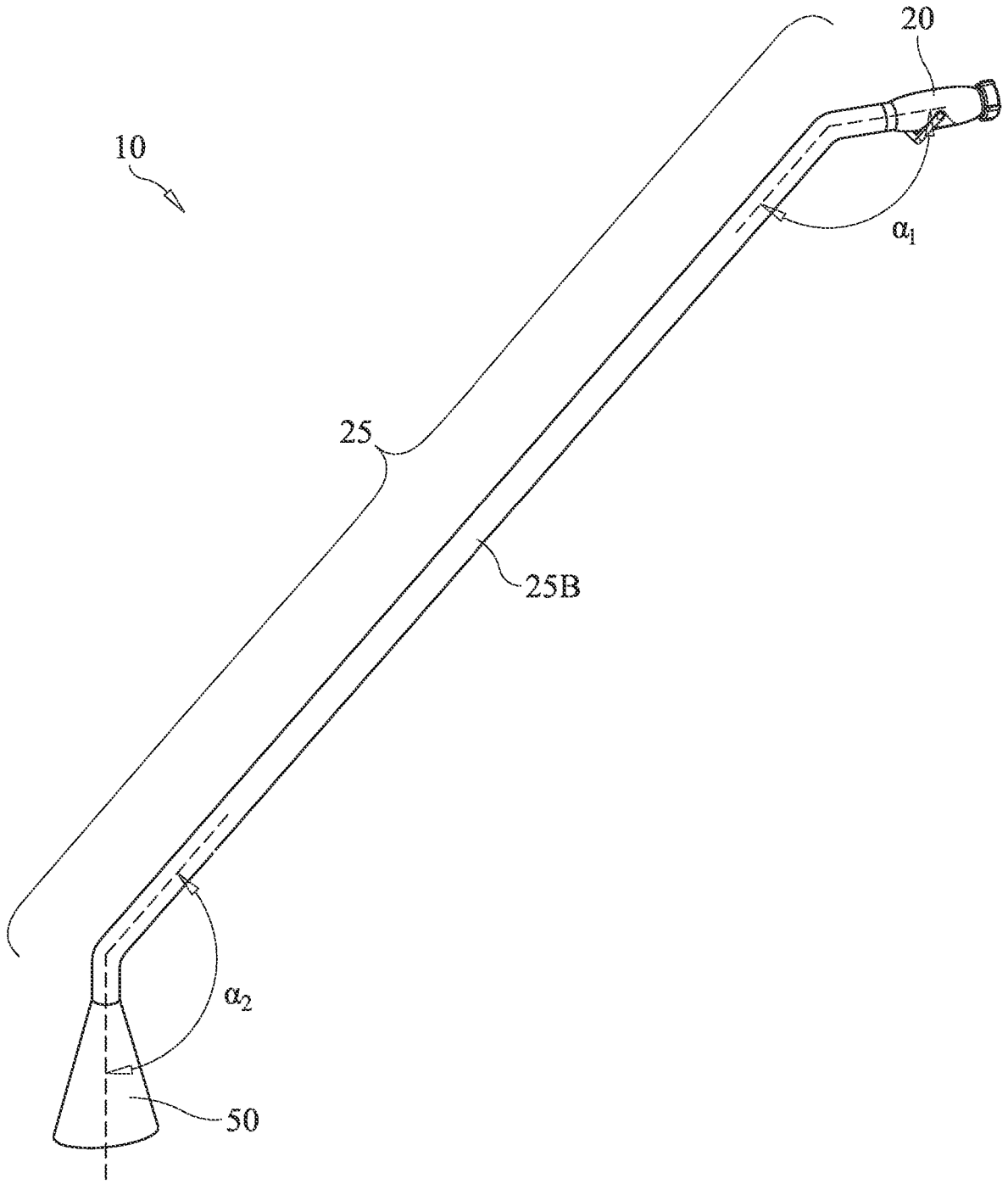
FIG. 1A depicts a perspective view of an alternative embodiment of the apparatus.

An alternative exemplary embodiment of the apparatus 110, hereinafter referred to as the alternative apparatus 110, is disclosed to be configured with several integrally formed components. The alternative apparatus 110 includes the handle 20, an alternative conduit 125, and an alternative nozzle 130 and splash guard 150 that are permanently coupled to one another. The conduit 125 is preferably rigid and formed of an integrally formed cylindrical conduit, such as, but not limited, to a bent pipe. As shown in FIG. 1A, the conduit 125 may be formed to have three or more longitudinal axes, be formed of a substantially straight cylindrical conduit that is strained, with or without preheating, at two or more locations such that its longitudinal axis is rotated substantially at each location in the same direction and that the resulting cumulative rotations at the two or more locations combine to be substantially ninety degrees, or be of unitary construction.

Figure 5A:
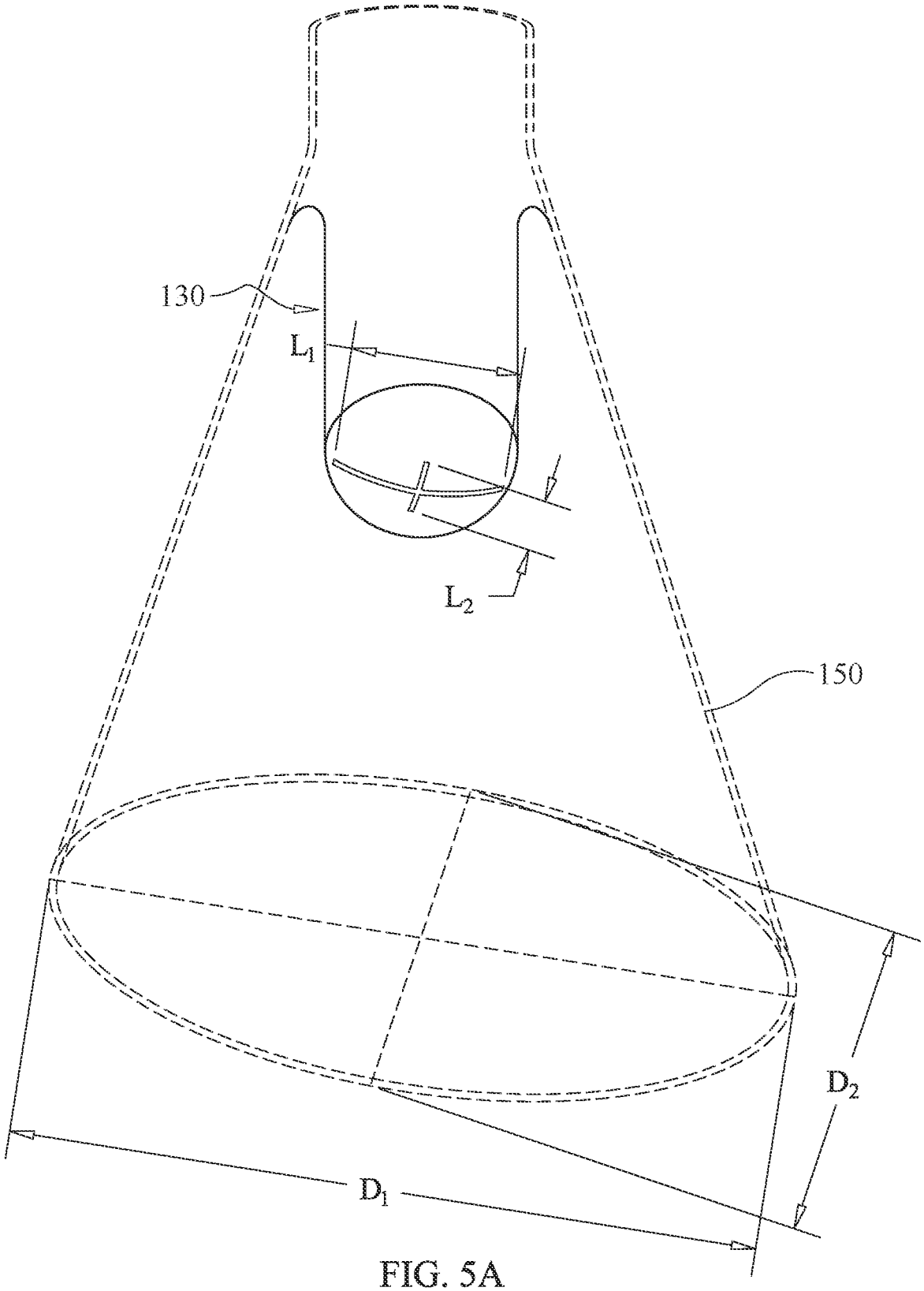
FIG. 5A depicts an enlarged perspective view of a nozzle and splash guard of the alternative embodiment of the apparatus wherein said integrated nozzle and splash guard are integrally formed with one another.
Figure 6:
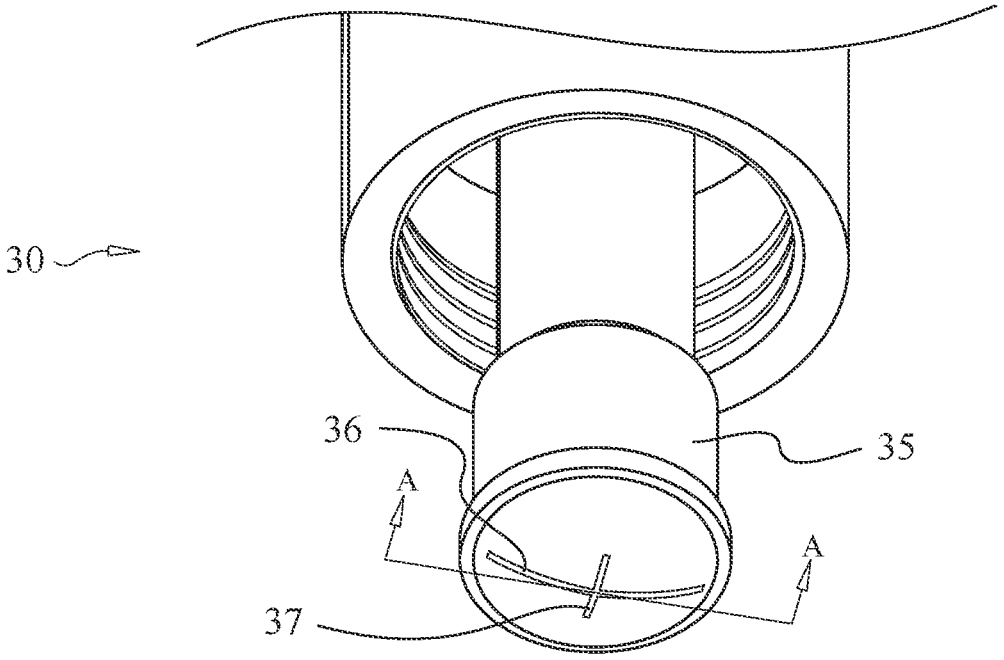
FIG. 6 depicts an enlarged perspective view of the nozzle of the exemplary embodiment of the apparatus.

The nozzle 130 and splash guard 150 are preferably integrally connected to one another. It is anticipated that the two components 130, 150 could be of unitary construction or integrally formed. As shown in FIG. 5A, the interior surface of the splash guard 150 and exterior surface of the nozzle 130 are substantially smooth and thereby reduce the locations where animal excrement particulate could build up or remain after use. As shown in FIG. 5A, the width of the cone wall, which is substantially constant for the majority of the truncated cones height, increases at a predetermined height above the distal base such that the interior surface of the splash guard 150 smoothly transitions inwardly about a predetermined curve, which forms a surface revolution about the longitudinal axis of the nozzle, to join with the exterior surface of the nozzle 130.

Additionally, it is anticipated that the integral coupling of the nozzle 130 and splash guard 150 reduce the locations where leaks may occur and thereby improve the durability of the apparatus. The inlet of the nozzle 130 is the proximal top end of the splash guard 150 and includes a coupling mechanism to allow for quick attachment to the second end 125B of the conduit 125. The coupling mechanism is preferably a threaded connection wherein the inlet of the nozzle 130, which in this alternative embodiment is the same as the proximal top end of the splash guard 150, provides internal threads which function to receive external threads provided by the second end 125B of the conduit 125. However, it is anticipated that alternative coupling mechanisms, such as, but not limited to a gasketed spring loaded quick connect mechanism, could be utilized to achieve a substantially watertight seal.

An additional advantage of the arrangement of the slits 36, 37 and splash guard 50/150 is that the churning effect created by the discharged water enables the apparatus to self-clean the interior surface of the splash guard 50/150, which further improves the hygienic benefits of using this apparatus 10. It is further anticipated that a non-stick coating may be applied to the interior surface of the splash guard 50/150 to further reduce the residual accumulation of animal excrement 70 on the interior surface of the splash guard 50.

It is anticipated that the exemplary embodiment of the apparatus and the alternative embodiment, may be configured such that the first and second angles $\alpha_1$, $\alpha_2$ are each independently adjustable by the utilization of bendable or flexible materials or components. It is further anticipated that the conduit 25 of the exemplary embodiment of the apparatus and the alternative embodiment, may be configured such that the conduit 25 is further comprised of one or more additional sections, which allow for telescopically extending along one or more of the longitudinal axes of conduit 25.

Figure 11:
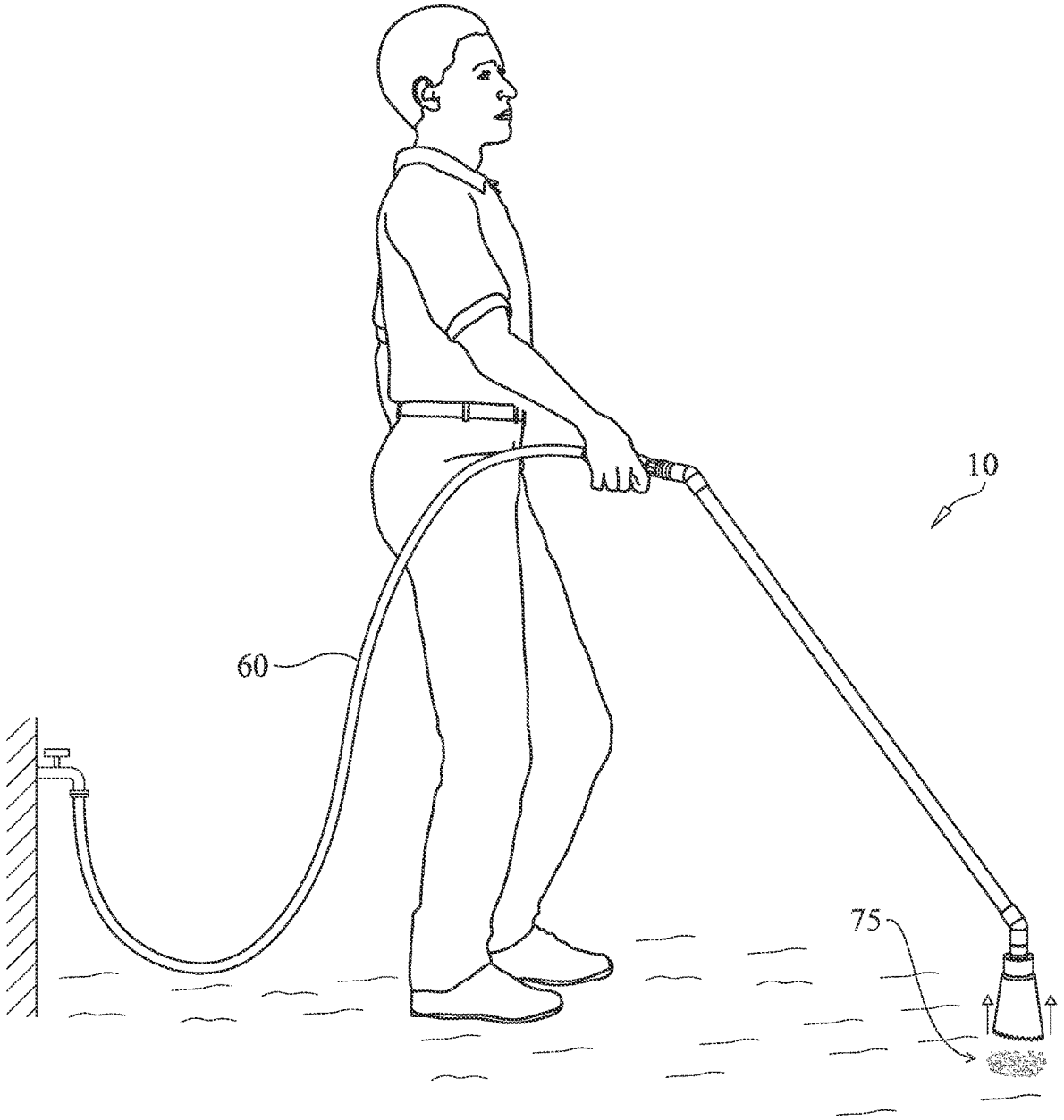
FIG. 11 depicts the in-use perspective view from FIG. 9 wherein the exemplary user has completed disintegrating and dissolving the exemplary animal excrement, actuated the lever to its closed position, and is raising the splash guard thereby exposing the remaining heterogenous mixture which has not yet permeated into the below substrate.

An exemplary method of using the apparatus is presented herein to further demonstrate the convenience and efficiency of the apparatus. An exemplary user of the exemplary embodiment of the apparatus 10 is illustrated in FIGS. 10 and 11. To properly use the apparatus the exemplary user must first assemble the apparatus by coupling the first end 25A/125A of the conduit 25/125 to the distal end 20B of the handle 20 and coupling the second end 25B/125B of the conduit 25/125 to the inlet of the nozzle 30/130 (Step 1). With respect to the exemplary embodiment of the apparatus presented herein, the exemplary user must take an additional step of attaching the top proximal end of the splash guard 50 to the coupler 31 provided by the nozzle 30 (Step 1A).

The exemplary user must then configure the lever 21 such that the internal valve 22 is disposed to a fully closed position (Step 2). After the components of the apparatus are properly connected to one another and the lever 21 is configured such that the internal valve 22 is disposed in its fully closed position, the exemplary user must then fluidly couple the proximal end 20A of the handle 20 to the water source 60, preferably while the water source is not actively providing pressurized water (Step 3). If the water source 60 was not actively providing pressurized water before the proximal end 20A, the exemplary user must then take one or more necessary ancillary steps to ensure that the water source 60 is actively providing pressurized water to the proximal end 20A (Step 3A).

The exemplary user must then position the apparatus such that the splash guard 50/150 fully encloses the exemplary animal excrement 70 by configuring the bottom edge 55/155 of the splash guard to be in contact with the in-situ substrate (Step 4). The exemplary user may adjust the first and second angles $\alpha_1$, $\alpha_2$ to assist in configuring the bottom edge 55/155 of the splash guard to be in contact with the in-situ substrate (Step 4*a*). The exemplary user must then configure the lever 21 to an orientation which disposes the internal valve 22 to a position that is not fully closed (Step 5). The exemplary user must then configure the apparatus to ensure that the substantial entirety of the bottom edge 55/155 of the splash guard 50/150 maintains substantial contact with the in-situ substrate for a period of time, preferably not less than approximately two seconds (Step 6). The exemplary user must then configure the lever 21 such that the internal valve 22 is disposed to a fully closed position (Step 7). After the internal valve 22 has been disposed to a fully closed position, the exemplary user may then raise the splash guard 50/150 (Step 8).

The exemplary user may optionally elect to self-clean the internal surface of the splash guard and external surfaces of the nozzle that are exposed within the internal volume of the splash guard by placing the bottom edge 55/155 over a surface that does not enclose the exemplary animal excrement, or any other undesirable contaminants, and repeating steps 5-8 (Step 9).

Upon completion of Step 1, as well as Step 1A for embodiments of the apparatus which do not include an integrally attached nozzle 130 and splash guard 150, subsequent use of the apparatus after its initial assembly will not necessitate reassembly of the apparatus, unless the exemplary user elects to subsequently disassembles one or more of the components of the apparatus.

The heterogenous mixture 75 may be left to passively permeate into the in-situ substrate. It is important to note that during the predetermined duration of time, the pressurization of the heterogenous mixture within the internal volume of the splash guard 50/150 encourages the forceful evacuation of the heterogenous mixture through the open distal base. Preferably the exemplary animal excrement 70 is situated on in-situ substrate that is not impermeable to prevent substantial splatter and surface dispersion of the heterogenous mixture 75.

While the exemplary embodiment of the present disclosure has been disclosed, certain modifications may be made by those skilled in the art to modify the invention without departing from the spirit of the invention.

What is claimed:

1. An apparatus which aids in disintegrating and dissolving animal excrement, the apparatus comprising:

a handle;
- wherein the handle comprises an inner conduit, an internal valve, a proximal end, and a distal end;
- wherein the proximal end fluidly couples to a water source;
- wherein the handle further comprises an external lever;
- wherein the internal valve is located in between the proximal end and the distal end;
- wherein the internal valve is operably coupled to the external lever;

a conduit;
- wherein the conduit comprises a first end and a second end;
- wherein the first end is mechanically coupled to and in fluid communication with the distal end of the handle;
- wherein the conduit further comprises at least three longitudinal axes;
- wherein each of the at least three longitudinal axes is planar with respect to each other;

a nozzle and a splash guard;
- wherein the nozzle and the splash guard are integrally connected to one another;
- wherein the splash guard comprises a profile that is substantially a truncated cone;
- wherein the splash guard further comprises a proximal top end and a distal base;
- wherein the proximal top end is mechanically coupled to the second end of the conduit;
- wherein the nozzle comprises an inlet and an exit orifice;
- wherein the inlet of the nozzle is in fluid communication with the second end of the conduit;
- wherein the exit orifice is vertically offset from the distal base of the splash guard by a predetermined distance;
- wherein the exit orifice comprises a first slit and a second slit;
- wherein the first and second slits each comprise a curved trajectory; and
- wherein the first and second slits intersect each other at their substantial midpoints and are substantially tangentially orthogonal at their point of intersection with respect to one another.

2. The apparatus as described in claim 1, wherein the interior surface of the splash guard smoothly transitions about a predetermined curve to join with the exterior surface of the nozzle.

3. The apparatus as described in claim 1, wherein the distal base of the splash guard further comprises a bottom edge.

4. The apparatus as described in claim 3, wherein the bottom edge of the distal base comprises a saw tooth shaped profile.

5. The apparatus as described in claim 3, wherein the bottom edge of the distal base comprises a beveled profile.

6. The apparatus as described in claim 1, wherein the conduit extends telescopically along at least one of the conduit's longitudinal axes.

7. The apparatus as described in claim 1, wherein a boundary of the distal base has a semi-major axis and semi-minor axis; and wherein the first slit comprises a linear projected length which is proportionally related to the semi-major axis of the distal base.

8. The apparatus as described in claim 7, wherein the second slit comprises a linear projected length which is proportionally related to the semi-minor axis of the distal base.

9. A method of disposing of animal excrement, comprising:

providing the apparatus as described in claim 1;

configuring the lever such that the internal valve is disposed to a fully closed position;

coupling the proximal end of the handle to a pressurized water source;

disposing the apparatus such that the splash guard fully encloses the animal excrement and the bottom edge is in contact with an in-situ substrate;

configuring the lever such that the internal valve is not disposed in a fully closed position for a predetermined duration of time;

configuring the lever such that the internal valve is disposed in a fully closed position; and disposing the apparatus such that the splash guard is elevated and not in contact with the in-situ substrate.

10. An apparatus which aids in disintegrating and dissolving animal excrement, the apparatus comprising:

a handle;

wherein the handle comprises an inner conduit, an internal valve, a proximal end, and a distal end;

wherein the proximal end fluidly couples to a water source;

wherein the handle further comprises an external lever;

wherein the internal valve is located in between the proximal end and the distal end;

wherein the internal valve is operably coupled to the external lever;

a conduit;

wherein the conduit comprises a first end and a second end;

wherein the first end is mechanically coupled to and in fluid communication with the distal end of the handle;

a nozzle and a splash guard;

wherein the nozzle and the splash guard are mechanically coupled to one another;

wherein the splash guard comprises a profile that is substantially a truncated cone;

wherein the splash guard further comprises a proximal top end and a distal base;

wherein the nozzle comprises an inlet and an exit orifice;

wherein the inlet is mechanically coupled to and in fluid communication with the second end of the conduit;

wherein the exit orifice is vertically offset from the distal base of the splash guard by a predetermined distance;

wherein the exit orifice comprises a first slit and a second slit;

wherein the first and second slits each comprise a curved trajectory; and wherein the first and second slits intersect each other at their substantial midpoints and are substantially tangentially orthogonal at their point of intersection with respect to one another.

11. The apparatus as described in claim 10, wherein the distal base of the splash guard further comprises a bottom edge.

12. The apparatus as described in claim 11, wherein the bottom edge of the distal base comprises a substantially flat profile.

13. The apparatus as described in claim 11, wherein the bottom edge of the distal base comprises a beveled profile.

14. The apparatus as described in claim 10, wherein the conduit further comprises at least three longitudinal axes; and wherein the conduit extends telescopically along at least one of the longitudinal axes of the conduit.

15. The apparatus as described in claim 10, wherein a boundary of the distal base has a semi-major axis and semi-minor axis; and wherein the first slit comprises a linear projected length which is proportionally related to the semi-major axis of the distal base.

16. The apparatus as described in claim 15, wherein the second slit comprises a linear projected length which is proportionally related to the semi-minor axis of the distal base.

* * * * *